US012565754B2

(12) United States Patent
Nakajima et al.

(10) Patent No.: US 12,565,754 B2
(45) Date of Patent: Mar. 3, 2026

(54) HYDRAULIC CONTROL SYSTEM IN EXCAVATOR TYPE CONSTRUCTION MACHINE

(71) Applicant: Caterpillar SARL, Geneva (CH)

(72) Inventors: Hideki Nakajima, Akashi (JP); Koichi Kiyasu, Akashi (JP)

(73) Assignee: Caterpillar SARL, Geneva (CH)

( * ) Notice: Subject to any disclaimer, the term of this patent is extended or adjusted under 35 U.S.C. 154(b) by 112 days.

(21) Appl. No.: 18/686,626

(22) PCT Filed: Aug. 19, 2022

(86) PCT No.: PCT/EP2022/025384
§ 371 (c)(1),
(2) Date: Feb. 26, 2024

(87) PCT Pub. No.: WO2023/025413
PCT Pub. Date: Mar. 2, 2023

(65) Prior Publication Data

US 2024/0426077 A1 Dec. 26, 2024

(30) Foreign Application Priority Data

Aug. 26, 2021 (JP) ..... 2021-137856

(51) Int. Cl.
*E02F 9/12* (2006.01)
*E02F 9/22* (2006.01)

(52) U.S. Cl.
CPC ..... *E02F 9/123* (2013.01); *E02F 9/2242* (2013.01); *E02F 9/2292* (2013.01); *E02F 9/2296* (2013.01)

(58) Field of Classification Search
None
See application file for complete search history.

(56) References Cited

U.S. PATENT DOCUMENTS 5,056,312 A * 10/1991 Hirata ..... E02F 9/2292 60/426
5,134,853 A * 8/1992 Hirata ..... F15B 21/087 60/420

(Continued)

FOREIGN PATENT DOCUMENTS

JP 2017020604 A 1/2017
JP 2021028499 A 2/2021

(Continued)

OTHER PUBLICATIONS

Machine translation of JP 2017020604 A to English from PE2Esearch (Year: 2025).*

(Continued)

*Primary Examiner* — Michael Quandt

(57) ABSTRACT

Problem to Be Solved: To investigate an opening area control of a flow control valve disposed on upstream side of the stick's direction change-over valve when using the flow control valve as a valve for restricting the supply flow rate to stick cylinder during interlocking operation of the swiveling motor and stick cylinder. Solution: A configuration is provided to control the opening area of the stick's first flow control valve based on a target supply flow rate to the stick cylinder, target differential pressure between first hydraulic pump A and supply pressure to the stick cylinder, and opening area of supply valve passage to the stick's direction change-over valve and also control that the differential pressure is set larger as operating amount of swiveling manipulator increases during interlocking operation of the swiveling motor and stick cylinder and the opening area of stick's first flow control valve is made smaller as the differential pressure increases.

2 Claims, 5 Drawing Sheets

(56) References Cited

U.S. PATENT DOCUMENTS

| | | | | |
|---|---|---|---|---|
| 5,186,000 | A * | 2/1993 | Hirata | E02F 9/2296 91/447 |
| 2018/0127949 | A1 | 5/2018 | Nakajima | |

FOREIGN PATENT DOCUMENTS

| | | | |
|---|---|---|---|
| JP | 2021110406 | A | 8/2021 |
| JP | 2022120978 | A | 8/2022 |

OTHER PUBLICATIONS

International Search Report related to Application No. PCT/EP2022/025384; reported on Dec. 22, 2022.

* cited by examiner

HYDRAULIC CONTROL SYSTEM IN EXCAVATOR TYPE CONSTRUCTION MACHINE

CROSS-REFERENCE TO RELATED APPLICATION

This application is a USC § 371 US National Stage filing International Application No. PCT/EP2022/025384 filed on Aug. 19, 2022 which claims priority under the Paris Convention to Japanese Patent Application 2021-137856 filed on Aug. 26, 2021.

FIELD OF THE INVENTION

The present invention relates to a technical field of hydraulic control system used in excavator type construction machine such as a hydraulic excavator.

BACKGROUND OF THE INVENTION

In general, an excavator type construction machine such as a hydraulic excavator is provided with various types of hydraulic actuators; as a hydraulic control system for controlling an oil supply/discharge of the hydraulic actuator, a configuration is well known conventionally which has a single spool valve for simultaneously performing a direction change-over control, supply flow control, and discharge flow control for the hydraulic actuator. However, when the single spool valve controls the supply/discharge flow rates, since a relationship of supply side's opening area and discharge side's opening area relative to the spool's moved position is uniquely determined, a problem of degraded working efficiency and operability arises that cannot change the relationship between the supply/discharge flow rates depending on an operating state, for example, such as an individual operation actuating the single hydraulic actuator alone and an interlocking operation actuating multiple hydraulic actuators at the same time, or various contents of work.

There is a conventional technology for controlling a supply flow rate to and discharge flow rate from the hydraulic actuator independently of one another, the technology is provided with: a direction change-over valve having supply/discharge valve passages to/from the hydraulic actuator and also changing over supply/discharge directions, a flow control valve arranged at the upstream side of the direction change-over valve for controlling the supply flow rate from a hydraulic pump to the direction change-over valve, and a control means for controlling the direction change-over valve and flow control valve (see PTLs 1, 2, for example). This technology has a configuration which uses the flow control valve for controlling the supply flow rate for the hydraulic actuator (for PTL 2, only when an operating amount of hydraulic actuator's manipulator is not less than a setting value) but uses the direction change-over valve for controlling the discharge flow rate, thus enabling to change the relationship between the supply/discharge flow rates depending on operating state or content of work.

The excavator type construction machine such as the hydraulic excavator is provided with a swiveling motor as the hydraulic actuator for swiveling the upper swiveling body and the working machine's hydraulic actuator mounted on the upper swiveling body; since a swiveling of upper swiveling body by the swiveling motor is heavily loaded, when the swiveling motor and the working machine's hydraulic actuator, which shares the hydraulic pump with the swiveling motor, are interlockingly operated (at the same time), many pump delivery flow rates run into the working machine's hydraulic actuator with low load pressure, causing a problem that reduces swiveling power due to the insufficient flow rate for the swiveling motor. This problem needs to be considered in the technology like PTLs 1, 2 described above which is configured to control the supply/discharge flow rates independently of one another, so in the PTL 2 described above, when operating swiveling and working machine manipulators, it is proposed that the pressured oil is supplied preferentially to the swiveling motor by using the flow control valve mounted on the upstream side of a working machine's direction change-over valve as a swivel preferred flow control valve and reducing the supply flow rate to the working machine's hydraulic actuator with the swivel preferred flow control valve.

PRIOR ART DOCUMENTS

Patent Documents

PTL 1: Japanese Unexamined Patent Application Publication No. 2017-20604

PTL 2: Japanese Unexamined Patent Application Publication No. 2021-28499

SUMMARY OF THE INVENTION

Problems to be Solved by the Invention

However, when operating swiveling and working machine manipulators interlockingly, the technology in the PTL 2 is to control an opening area of the swivel preferred flow control valve in order to reduce the supply flow rate to the working machine's hydraulic actuator, but, here, it is not considered how to control the opening area of the swivel preferred flow control valve; this is a challenge for the present invention to solve.

Means For Solving The Problems

This invention is created for the purpose of solving the problem in consideration of current condition mentioned above; a claim 1 of this invention provides: a hydraulic control system for an excavator type construction machine comprising an upper swiveling body swivelably supported on a lower traveling body and a working machine mounted on the upper swiveling body; wherein the hydraulic control system has: a swiveling motor for swiveling the upper swiveling body, a hydraulic pump as a hydraulic supply source to the swiveling motor, a working machine's hydraulic actuator sharing the hydraulic pump with the swiveling motor, a swiveling's direction change-over valve having supply/discharge valve passages for the swiveling motor and changing over its supply/discharge directions, a working machine's direction change-over valve having supply/discharge valve passages for the working machine's hydraulic actuator and changing over its supply/discharge directions, a flow control valve arranged at the upstream side of the working machine's direction change-over valve for controlling the supply flow rate from the hydraulic pump to the working machine's direction change-over valve, and a control means for controlling the operation of the swiveling's/working machine's direction change-over valves and flow control valve; wherein the control means comprises: a target supply flow rate setting means for setting up the target supply flow rates from hydraulic pump to swiveling motor and working machine's hydraulic actuator, a direction change-over valve control means for controlling the opening area of supply/discharge valve passages for the swiveling's/working machine's direction change-over valves, a target differential pressure setting means for setting up a target differential pressure between a hydraulic pump's delivery pressure and supply pressure to working machine's hydraulic actuator, and a flow control valve control means for controlling the opening area of the flow control valve based on the target supply flow rate to working machine's hydraulic actuator, the target differential pressure, and the opening area of the supply valve passage to the working machine's direction change-over valve; wherein, when the swiveling motor and working machine's hydraulic actuator are interlocking with each other, the target supply flow rate setting means sets up that the target differential pressure between the hydraulic pump's delivery pressure and supply pressure to working machine's hydraulic actuator during interlocking operation is larger than the target differential pressure during non-interlocking operation of the swiveling motor and working machine's hydraulic actuator as an operating amount of the swiveling manipulator becomes large, and the flow control valve control means controls to make the opening area of flow control valve smaller as the target differential pressure becomes large.

The claim 2 of this invention is the hydraulic control system for excavator type construction machine as claimed in claim 1, wherein, when controlling the opening area of flow control valve, the flow control valve control means controls the flow control valve so as to keep a target opening area after calculating the differential pressure before and after the supply valve passage based on the target supply flow rate to the working machine's hydraulic actuator and the opening area of the supply valve passage to the working machine's direction change-over valve, calculating the differential pressure before and after the flow control valve based on the differential pressure calculated before and after the supply valve passage and target differential pressure, and further calculating the target opening area of the flow control valve based on the differential pressure calculated before and after the flow control valve and target supply flow rate.

Favorable Effects of the Invention

According to the invention of claim 1, an opening area of flow control valve during interlocking operation of the swiveling motor and working machine's hydraulic actuator can be easily controlled only by changing target differential pressure setting based on the opening area control of the flow control valve during non-interlocking operation, helping to simplify the control and reducing time to tune only for interlocking operation.

According to the invention of claim 2, the opening area of the flow control valve can be controlled accurately, helping to improve an accuracy of the supply flow rate control.

DETAILED DESCRIPTION OF THE INVENTION

Now, an explanation is provided below about an embodiment of the present invention based on drawings.

Figure 1:
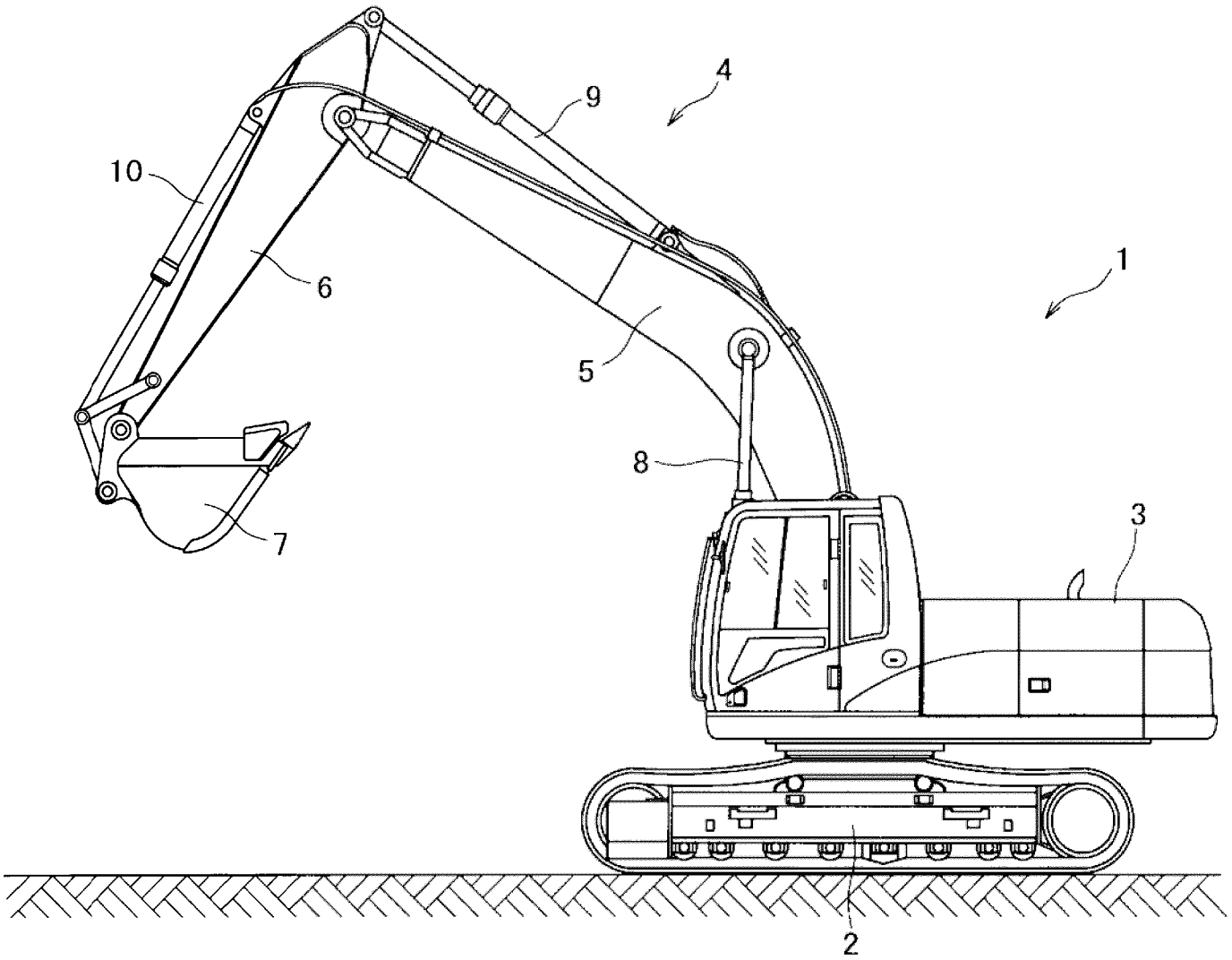
FIG. 1 is a side view of a hydraulic excavator.

FIG. 1 is a drawing illustrating hydraulic excavator 1 as an example of excavator type construction machine according to this invention, wherein the hydraulic excavator 1 is configured of: a crawler type lower traveling body 2, an upper swiveling body 3 swivelably supported above the lower traveling body 2, a working machine 4 mounted on the upper swiveling body 3, and others; and furthermore, the working machine 4 is configured of: a boom 5 whose base end part is supported vertically swingably by the upper swiveling body 3, a stick 6 longitudinally swingably supported on an end part of the boom 5, a bucket 7 swingably fitted on an end part of the stick 6, and others; wherein the hydraulic excavator 1 has various hydraulic actuators, such as a boom cylinder 8, stick cylinder 9, and bucket cylinder 10 for swinging the boom 5, stick 6, and bucket 7 respectively, left and right traveling motors (not shown) for driving the lower traveling body 2, and swiveling motor 11 (shown in FIG. 2) for swiveling the upper swiveling body 3.

Figure 2:
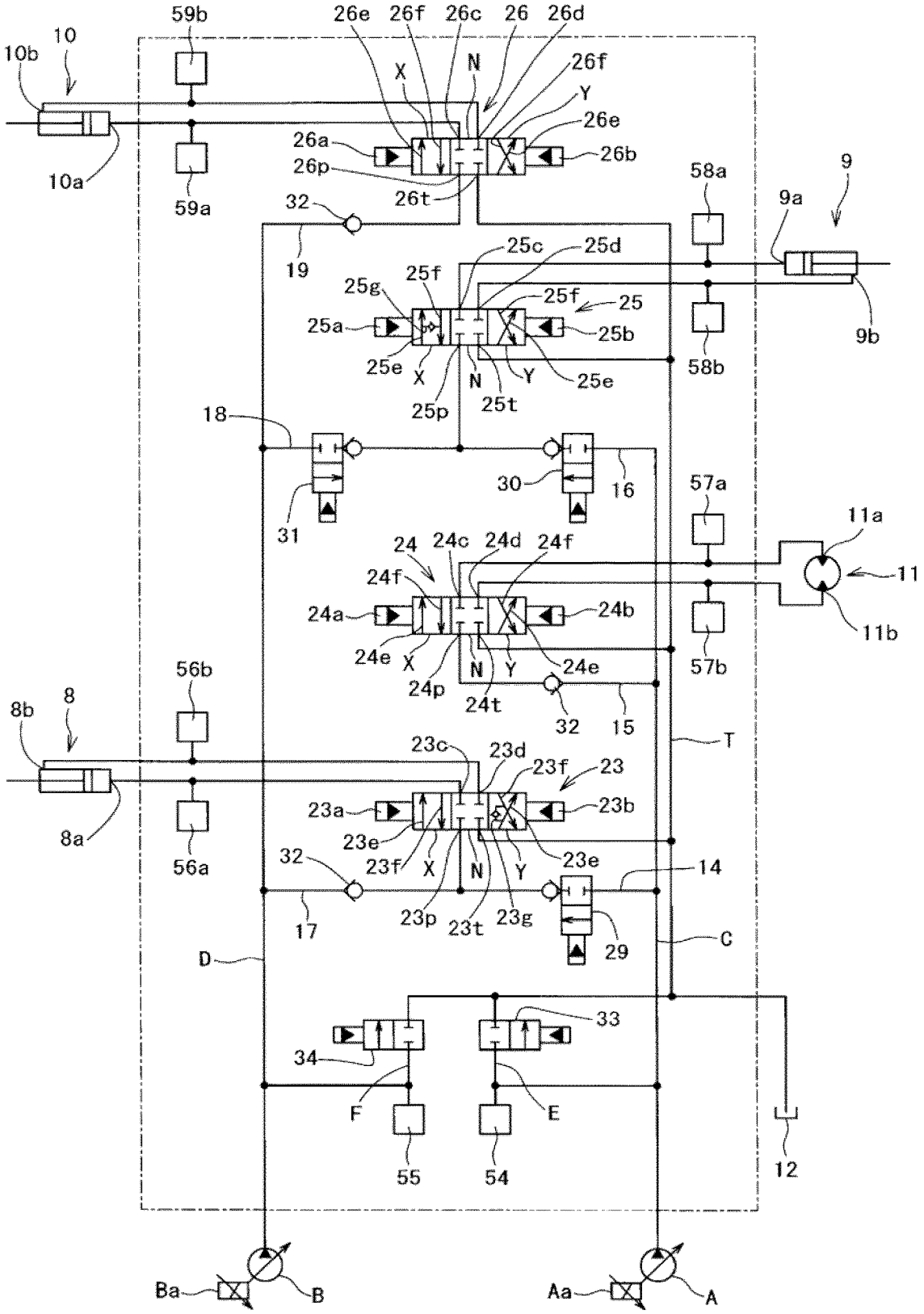
FIG. 2 is a hydraulic circuit diagram of the hydraulic excavator.

Next, an explanation is provided about the hydraulic control system installed in the hydraulic excavator 1 based on the hydraulic circuit diagram shown in the FIG. 2. Note that hydraulic circuit concerning traveling motor is omitted in the FIG. 2.

In the FIGS. 2, A and B are first and second variable capacity hydraulic pumps, Aa and Ba are variable capacity means for making the capacity of first and second hydraulic pumps A, B variable based on a control signal from a controller 39 mentioned later, and 12 is an oil tank. Also, 8, 9, 10, and 11 are the boom cylinder, stick cylinder, bucket cylinder and swiveling motor; the present embodiment is configured that the boom cylinder 8 and stick cylinder 9 of all these hydraulic actuators are supplied with oil pressure from both first and second hydraulic pumps A, B, the bucket cylinder 10 is supplied with oil pressure from the second hydraulic pump B, and the swiveling motor 11 is supplied with oil pressure from the first hydraulic pump A. Note that, in the present embodiment, first hydraulic pump A is equivalent to hydraulic pump which supplies hydraulic pressure to the swiveling motor of this invention, but second hydraulic pump B is not equivalent to the hydraulic pump. In the present embodiment, the stick cylinder 9 is equivalent to working machine's hydraulic actuator of this invention, as mentioned later, which shares the hydraulic pump with the swiveling motor.

Furthermore, in the FIG. 2, C is a first pump line connected to a delivery side of the first hydraulic pump A; a boom's subside/swiveling's/stick's main side supply oil passages 14, 15, and 16 are branched out in parallel from the first pump line C. Also, D is a second pump line connected to the delivery side of the second hydraulic pump B; a boom's main side/stick's subside/bucket's supply oil passages 17, 18, and 19 are branched out in parallel from the second pump line D. The boom's subside/main side supply oil passages 14, 17 are oil passages connecting first and second hydraulic pumps A, B respectively to a pump port 23*p* on the boom's direction change-over valve 23 mentioned later; the swiveling's supply oil passage 15 is the oil passage connecting first hydraulic pump A to the pump port 24*p* on the swiveling's direction change-over valve 24;

stick's main side/subside supply oil passages 16, 18 are the oil passages respectively connecting first and second hydraulic pumps A, B to the pump port 25*p* on the stick's direction change-over valve 25; and bucket's supply oil passage 19 is the oil passage connecting second hydraulic pump B to the pump port 26*p* on the bucket's direction change-over valve 26.

The boom's subside supply oil passage 14 is provided with the boom's flow control valve 29, which controls to feed a supply flow for the boom cylinder 8 from first hydraulic pump A to the boom's direction change-over valve 23; also, the stick's main side/subside supply oil passages 16, 18 are provided with stick's first and second flow control valves 30, 31, which control to feed supply flows respectively for the stick cylinder 9 from first and second hydraulic pumps A, B to the stick's direction change-over valve 25. These boom's/stick's first/stick's second flow control valves 29, 30, and 31 are a poppet valve pilot-operated for flow rate control by the boom's/stick's first/stick's second flow control proportional solenoid valves 40, 41, and 42 (shown in FIG. 3) working based on control signal output from the controller 39, and have a back flow prevention function for allowing an oil flow from first hydraulic pump A to the boom's direction change-over valve 23 and from first and second hydraulic pumps A, B to the stick's direction change-over valve 25 but preventing a back flow. The stick's first flow control valve 30 functions as the swivel preferred flow control valve for restricting the supply flow rate to stick cylinder 9 in order to keep the supply pressure to swiveling motor 11 during interlocking (concurrent) operation of stick and swiveling manipulators, as mentioned later. Also, in the present embodiment, the stick's first flow control valve 30 is equivalent to the flow control valve of this invention, but the stick's second/boom's flow control valves 31, 29 are not equivalent to it.

The flow control valve like the boom's/stick's first/stick's second flow control valves 29, 30, and 31 mentioned above is not disposed to the swiveling's/boom's main side/bucket's supply oil passages 15, 17, and 19; the supply flow rate running through these passages 15, 17, and 19 from first or second hydraulic pump A or B is to be supplied as-is to swiveling's/boom's/bucket's direction change-over valves 24, 23, and 26 without being controlled. A check valve 32 is disposed on each of the swiveling's/boom's main side/bucket's supply oil passages 15, 17, and 19, and is to allow the oil flow from first and second hydraulic pumps A, B to the swiveling's/boom's/bucket's direction change-over valves 24, 23, and 26 but prevent its back flow.

Thus, the pressured oil is to be supplied to the pump port 23*p* on the boom's direction change-over valve 23 through boom's subside supply oil passage 14 from first hydraulic pump A and through boom's main side supply oil passage 17 from second hydraulic pump B; and the pressured oil from first hydraulic pump A is to be controlled (or interrupted) by boom's flow control valve 29 disposed on the boom's subside supply oil passage 14 to be supplied to boom's direction change-over valve 23. Also, the pressured oil is to be supplied to the pump port 25*p* on the stick's direction change-over valve 25 respectively through stick's main side supply oil passage 16 from first hydraulic pump A and through stick's subside supply oil passage 18 from second hydraulic pump B; the flow rate of the pressured oil from these first and second hydraulic pumps A, B is to be controlled (or interrupted) by the stick's main side/subside flow control valves 30, 31 disposed on the stick's main side/subside supply oil passages 16, 18 to be supplied to the stick's direction change-over valve 25.

Next, an explanation is provided about the direction change-over valves 23 to 26 for the boom, swiveling, stick, and bucket.

First, an explanation is provided about the swiveling's/bucket's direction change-over valves 24, 26 where the pressured oil is supplied from either one of first and second hydraulic pumps A, B and a flow control valve is not disposed on their upstream side.

The swiveling's direction change-over valve 24 is a closed center spool valve for controlling the supply/discharge flow rates of swiveling motor 11 as well as changing over its supply/discharge directions; and the valve 24 has: left/right turning pilot ports 24*a*, 24*b* respectively connected to swiveling's left/right turning proportional solenoid valves 44*a*, 44*b* (shown in FIG. 3) for outputting a pilot pressure based on control signal output from controller 39, a pump port 24*p* connected to the swiveling's supply oil passage 15, a tank port 24*t* connected to a tank line T to an oil tank 12, a first actuator port 24*c* connected to a left turning port 11*a* on the swiveling motor 11, and a second actuator port 24*d* connected to a right turning port 11*b* on the swiveling motor 11. Also, when no pilot pressure is input into both left/right turning pilot ports 24*a*, 24*b*, the swiveling's direction change-over valve 24 is positioned at neutral position N where the supply/discharge of swiveling motor 11 is not controlled; when the pilot pressure is input into the left turning pilot port 24*a*, the valve 24 is configured to be changed over to a left turning operating position X to open the supply valve passage 24*e* from pump port 24*p* to first actuator port 24*c* and discharge valve passage 24*f* from second actuator port 24*d* to tank port 24*t*; also when the pilot pressure is input into right turning pilot port 24*b*, the valve 24 is configured to be changed over to a right turning operating position Y to open the supply valve passage 24*e* from the pump port 24*p* to second actuator port 24*d* and discharge valve passage 24*f* from first actuator port 24*c* to the tank port 24*t*. When the valve 24 is positioned at left/right turning operating position X or Y, the supply/discharge flow rates for swiveling motor 11 are to be controlled by opening area of supply/discharge valve passages 24*e*, 24*f*, and the opening area is controlled to be increased or decreased depending on the spool move position associated with increase or decrease of the pilot pressure output from the swiveling's left/right turning proportional solenoid valves 44*a*, 44*b* to the left/right turning pilot ports 24*a*, 24*b*.

The bucket's direction change-over valve 26 is the closed center spool valve for controlling the supply/discharge flow rates of bucket cylinder 10 as well as changing over the supply/discharge directions; and the valve 26 has: extended side/contracted side pilot ports 26*a*, 26*b* respectively connected to bucket's extended side/contracted side proportional solenoid valves 46*a*, 46*b* (shown in FIG. 3) for outputting pilot pressure based on control signal output from controller 39, a pump port 26*p* connected to the bucket's supply oil passage 19, a tank port 26*t* connected to the tank line T, a first actuator port 26*c* connected to a head side port 10*a* on the bucket cylinder 10, and a second actuator port 26*d* connected to a rod side port 10*b* on the bucket cylinder 10. The bucket's direction change-over valve 26 has the same structure as the swiveling's direction change-over valve 24 mentioned above; when the valve 26 changes over from neutral position N to extended/contracted side operating position X or Y, the valve 26 is configured to open the supply valve passage 26*e* from pump port 26*p* to actuator port 26*c* or 26*d* and discharge valve passage 26*f* from the actuator port 26*d* or 26*c* to tank port 26*t* and control the supply/discharge flow rates depending on the opening area of the supply/discharge valve passages 26*e*, 26*f* to/from bucket cylinder 9; and the opening area is controlled to be increased or decreased depending on the spool move position according to the increase or decrease of the pilot pressure output from the bucket's extended side/contracted side proportional solenoid valves 46*a*, 46*b*.

Next, an explanation is provided about the boom's/stick's direction change-over valves 23, 25 where the pressured oil is supplied from both first and second hydraulic pumps A, B and the flow control valves 29, 30, and 31 are disposed on the upstream side.

The boom's direction change-over valve 23 is the closed center spool valve for controlling the supply/discharge/recycle flow rates of boom cylinder 8 as well as changing over the supply/discharge directions; and the valve 23 has: extended side/contracted side pilot ports 23*a*, 23*b* respectively connected to the boom's extended side/contracted side proportional solenoid valves 43*a*, 43*b* (shown in FIG. 3) for outputting pilot pressure based on control signal output from controller 39, the pump port 23*p* connected to the boom's subside/main side supply oil passages 14, 17, a tank port 23*t* connected to the tank line T, a first actuator port 23*c* connected to head side port 8*a* on the boom cylinder 8, and a second actuator port 23*d* connected to rod side port 8*b* on the boom cylinder 8. Also, when no pilot pressure is input into both extended side/contracted side pilot ports 23*a*, 23*b*, the boom's direction change-over valve 23 is positioned at neutral position N where the oil is neither supplied to nor discharged from boom cylinder 8; when the pilot pressure is input into the extended side pilot port 23*a*, the valve 23 is configured to be changed over to the extended side operating position X to open the supply valve passage 23*e* from pump port 23*p* to first actuator port 23*c* and discharge valve passage 23*f* from second actuator port 23*d* to tank port 23*t*; also when the pilot pressure is input into the contracted side pilot port 23*b*, the valve 23 is configured to be changed over to the contracted side operating position Y to open the supply valve passage 23*e* from the pump port 23*p* to the second actuator port 23*d*, discharge valve passage 23*f* from the first actuator port 23*c* to the tank port 23*t*, and recycle valve passage 23*g* which supplies a part of discharge oil as regenerated oil from the first actuator port 23*c* to the second actuator port 23*d*. The opening area of the supply/discharge/recycle valve passages 23*e*, 23*f*, and 23*g* is controlled to be increased or decreased depending on the spool's move position moved by the pilot pressure output from the boom's extended side/contracted side proportional solenoid valves 43*a*, 43*b*, and the discharge/recycle flow rates from the boom cylinder 8 are to be controlled by the opening area of the discharge/recycle valve passages 23*f*, 23*g*. As for the supply flow rate to the boom cylinder 8, the supply flow rate to the boom cylinder 8 through the boom's main side supply oil passage 17, where the flow control valve is not installed, from second hydraulic pump B is to be controlled by the opening area of the supply valve passage 23*e* to the boom's direction change-over valve 23; the supply flow rate to the boom cylinder 8 through the boom's subside supply oil passage 14, where the boom's flow control valve 29 is installed, from first hydraulic pump A is to be controlled by opening area of the boom's flow control valve 29 and opening area of the supply valve passage 23*e* to the boom's direction change-over valve 23.

The stick's direction change-over valve 25 is the closed center spool valve for controlling the supply/discharge/recycle flow rates of stick cylinder 9 as well as changing over the supply/discharge directions; and the valve 25 has: extended side/contracted side pilot ports 25*a*, 25*b* respectively connected to the stick's extended side/contracted side proportional solenoid valves 45*a*, 45*b* (shown in FIG. 3) for outputting the pilot pressure based on control signal output from controller 39, the pump port 25*p* connected to the stick's main side/subside supply oil passages 16, 18, a tank port 25*t* connected to the tank line T, a first actuator port 25*c* connected to a head side port 9*a* on the stick cylinder 9, and a second actuator port 25*d* connected to a rod side port 9*b* on the stick cylinder 9. Also, when no pilot pressure is input into both extended side/contracted side pilot ports 25*a*, 25*b*, the stick's direction change-over valve 25 is positioned at the neutral position N where the supply/discharge of stick cylinder 9 is not controlled; when the pilot pressure is input into the extended side pilot port 25*a*, the valve 25 is configured to be changed over to the extended side operating position X to open the supply valve passage 25*e* from pump port 25*p* to first actuator port 25*c*, discharge valve passage 25*f* from second actuator port 25*d* to tank port 25*t*, and recycle valve passage 25*g* which supplies a part of discharge oil as regenerated oil from second actuator port 25*d* to first actuator port 25*c*; also when the pilot pressure is input into the contracted side pilot port 25*b*, the valve 25 is configured to be changed over to the contracted side operating position Y to open the supply valve passage 25*e* from the pump port 25*p* to second actuator port 25*d* and discharge valve passage 25*f* from first actuator port 25*c* to the tank port 25*t*. The opening area of the supply/discharge/recycle valve passages 25*e*, 25*f*, and 25*g* is to be controlled to be increased or decreased depending on the spool's move position moved by the pilot pressure output from the stick's extended side/contracted side proportional solenoid valves 45*a*, 45*b*, and the discharge/recycle flow rates from stick cylinder 9 are to be controlled by the opening area of the discharge/recycle valve passages 25*f*, 25*g*. As for the supply flow rate to the stick cylinder 9, the supply flow rate through the stick's main side supply oil passage 16, where the stick's first flow control valve 30 is installed, from first hydraulic pump A to the stick cylinder 9 is to be controlled by opening area of the stick's first flow control valve 30 and opening area of the supply valve passage 25*e* to the stick's direction change-over valve 25; the supply flow rate through the stick's subside supply oil passage 18, where the stick's second flow control valve 31 is installed, from second hydraulic pump B to the stick cylinder 9 is to be controlled by opening area of the stick's second flow control valve 31 and opening area of the supply valve passage 25*e* to the stick's direction change-over valve 25. Note that the stick's direction change-over valve 25 is equivalent to working machine's direction change-over valve of this invention.

Further, in the FIGS. 2, E and F are first and second bleed lines respectively branched from an upstream position of all control valves 23 to 26 connected to the first and second pump lines C, D to the tank line T, and first and second bleed valves 33, 34 are respectively disposed on the first and second bleed lines E, F. These first and second bleed valves 33, 34 are to be operated respectively by the pilot pressure output from bleed's first and second proportional solenoid valves 47*a*, 47*b* (shown in FIG. 3) to control the increase or decrease of the bleed flow rate running from first and second hydraulic pumps A, B through first and second bleed lines E, F into the oil tank 12; and the bleed's first and second proportional solenoid valves 47*a*, 47*b* are to control the increase or decrease of pilot pressure output to the first and second bleed valves 33, 34 based on control signal output from controller 39.

Figure 3:
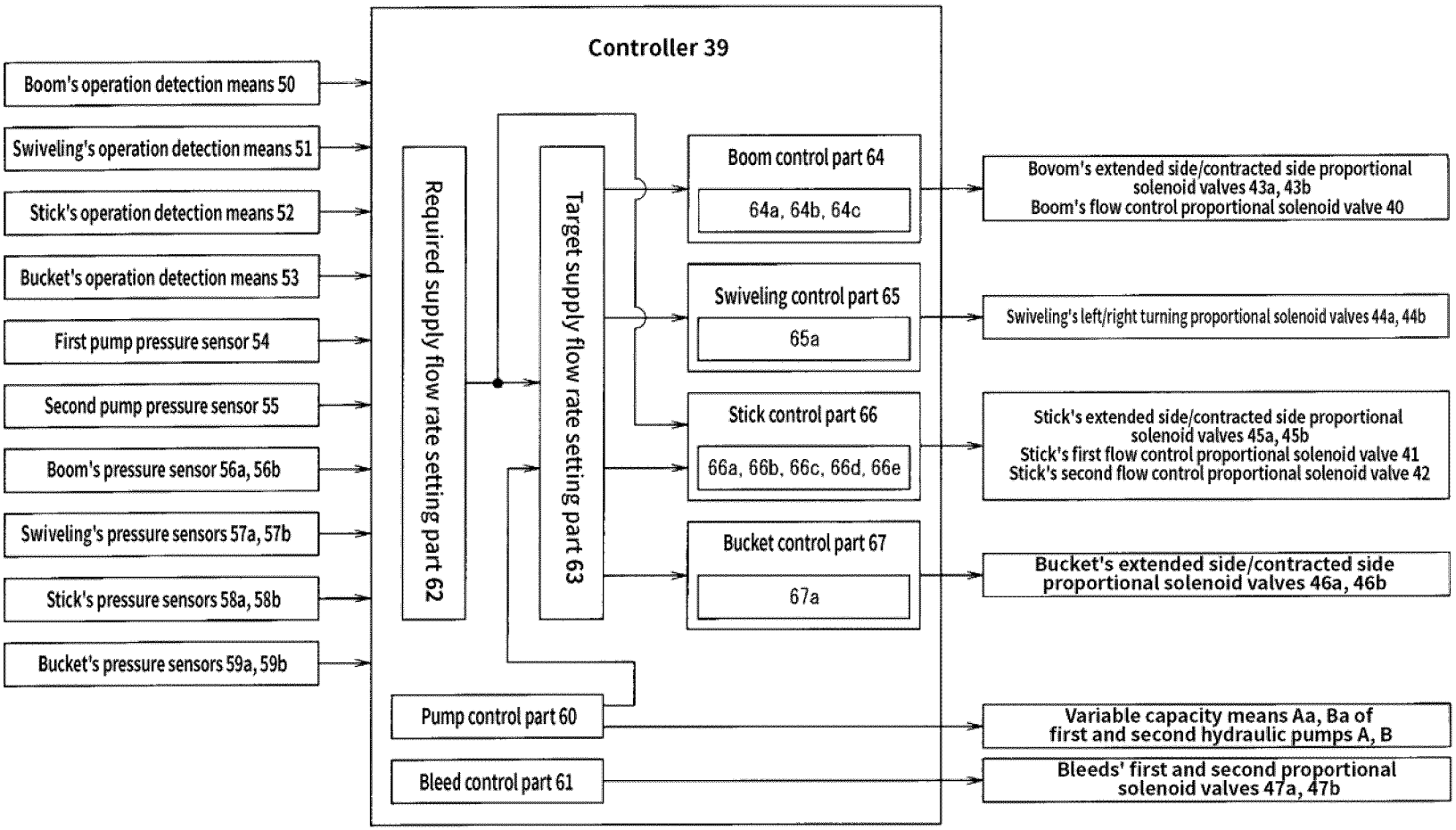
FIG. 3 is a block diagram illustrating a configuration of controller.

As shown in the block diagram of FIG. 3, at an input side, the controller 39 (corresponding to control means of this invention) is configured to be connected to: a boom's operation detection means 50 for detecting operating direction and amount of a boom manipulator, a swiveling's operation detection means 51 for detecting operating direction and amount of a swiveling manipulator, a stick's operation detection means 52 for detecting operating direction and amount of a stick manipulator (corresponding to the working machine manipulator of this invention), a bucket's operation detection means 53 for detecting operating direction and amount of a bucket manipulator, first and second pump pressure sensors 54, 55 for detecting delivery pressure of hydraulic pumps A, B, boom pressure sensors 56*a*, 56*b* for detecting head side/rod side load pressures of boom cylinder 8, swiveling pressure sensors 57*a*, 57*b* for detecting left turning/right turning load pressures of swiveling motor 11, stick pressure sensors 58*a*, 58*b* for detecting head side/rod side load pressure of stick cylinder 9, and bucket pressure sensors 59*a*, 59*b* for detecting head side/rod side load pressures of bucket cylinder 10, and others; and, at an output side, the controller 39 is configured to be connected to: the boom's/stick's/bucket's extended side/contracted side proportional solenoid valves 43*a*, 43*b*, 45*a*, 45*b*, and 46*a*, 46*b*, and swiveling's left/right turning proportional solenoid valves 44*a*, 44*b* for outputting pilot pressure to pilot ports 23*a*, 23*b*, 25*a*, 25*b*, 26*a*, 26*b*, and, 24*a*, 24*b* of the boom's/stick's/bucket's/swiveling's direction change-over valves 23, 25, 26, and 24, the boom's/stick's first/stick's second flow control proportional solenoid valves 40, 41, and 42 for outputting pilot pressure to the boom's/stick's first/stick's second flow control valves 29, 30, and 31 disposed on the boom's subside/stick's main side/stick's subside supply oil passages 14, 16, and 18, the bleed's proportional solenoid valves 47*a*, 47*b* for outputting pilot pressure to the first and second bleed valves 33, 34 respectively, and variable capacity means Aa, Ba of first and second hydraulic pumps A, B, and others; and the controller 39 is also configured to comprise pump/bleed/boom/swiveling/stick/bucket control parts 60, 61, 64, 65, 66, and 67, required/target supply flow rate setting parts 62, 63, and others, mentioned later.

Next, an explanation is provided about a control to be performed in the pump/bleed/boom/swiveling/stick/bucket control parts 60, 61, 64, 65, 66, and 67 and required/target supply flow rate setting parts 62, 63 installed in the controller 39.

The pump control part 60 calculates target delivery flow rate of first and second hydraulic pumps A, B based on the operation detection signal input from the boom's/swiveling'/stick's/bucket's operation detection means 50 to 53, delivery pressure of first and second hydraulic pumps A, B input from first and second pump pressure sensors 54, 55, and others, and outputs the control signal to the variable capacity means Aa, Ba of first and second hydraulic pumps A, B so as to obtain the target delivery flow rate. Here, the delivery flow rate of first and second hydraulic pumps A, B is controlled individually as the hydraulic supply source of hydraulic actuator to be operated.

The bleed control part 61 outputs the control signal to the bleed's first and second proportional solenoid valves 47*a*, 47*b* to control first and second bleed valves 33, 34 in order to decrease the bleed flow rate (including decreasing it to zero) running from first and second hydraulic pumps A, B into oil tank 12 based on the operation detection signal input from respective boom's/swiveling's/stick's/bucket's operation detection means 50 to 53 as operating amount of manipulator increases. The bleed flow rate for first and second bleed lines E, F is controlled individually according to first and second hydraulic pumps A, B as hydraulic supply source to hydraulic actuator operated (boom cylinder 8, swiveling motor 11, stick cylinder 9, and bucket cylinder 10).

The required supply flow rate setting part 62, when the detection signal is input from respective boom's/swiveling's/stick's/bucket's operation detection means 50 to 53, calculates a required supply flow rate for the boom cylinder 8, swiveling motor 11, stick cylinder 9, and bucket cylinder 10 depending on the operating amount of each manipulator. When calculating the required supply flow rate, the required supply flow rate for boom/stick cylinders 8, 9 using both first and second hydraulic pumps A, B as hydraulic supply source is set up respectively for first and second hydraulic pumps A, B. Here, when the operating amount of manipulator is less than the preset value L (L is set up individually according to the boom's/stick's manipulators), total amount of required supply flow rates for the boom/stick cylinders 8, 9 is requested to second and first hydraulic pumps B, A connected over the boom's/stick's main side supply oil passages 17, 16 and no required supply flow rate is requested to first and second hydraulic pumps A, B connected over the boom's/stick's subside supply oil passages 14, 18. When the operating amount of manipulator is not less than the setting value L, the required supply flow rate is set up individually to both first and second hydraulic pumps A, B so that a shortage of the supply flow rate from second and first hydraulic pumps B, A connected over the boom's/stick's main side supply oil passages 17, 16 can be supplied by first and second hydraulic pumps A, B connected over the boom's/stick's subside supply oil passages 14, 18. The required supply flow rate requested to the second and first hydraulic pumps B, A connected over the boom's/stick's main side supply oil passages 17, 16 is calculated over full operation range of the boom's/stick's manipulators, but the required supply flow rate requested to the first and second hydraulic pumps A, B connected over the boom's/stick's subside supply oil passages 14, 18 is calculated only when the operating amount of manipulator is not less than the preset value L.

The required supply flow rate setting part 62 has data for each hydraulic actuator, such as a map for example, which represents the relationship between the operating amount of manipulator and required supply flow rate; the setting part 62 sets the required supply flow rate for each hydraulic actuator larger by using the data as the operating amount of manipulator increases; the data is to be incorporated into the required supply flow rate setting part 62 as a control parameter, and for example, the required supply flow rate value corresponding to some operating amount of manipulator may be changed according to the content of work performed by hydraulic actuator 1.

The target supply flow rate setting part 63 inputs the target delivery flow rates of first and second hydraulic pumps A, B calculated in the pump control part 60 and the required supply flow rates for boom/stick/bucket cylinders 8, 9, and 10 and swiveling motor 11 calculated in the required supply flow rate setting part 62, and based on these input signals, calculates each target supply flow rate Q from first and second hydraulic pumps A, B to the boom/stick/bucket cylinders 8, 9, and 10 and swiveling motor 11. Here, when a sum of required supply flow rates for hydraulic actuators operated is greater than the target delivery flow rates from first and second hydraulic pumps A, B, each distributed flow rate is calculated by distributing the target delivery flow rates from the first and second hydraulic pumps A, B at a ratio of required supply flow rates of respective hydraulic actuators and the distributed flow rate is set to the target supply flow rate Q for each hydraulic actuator. As for the target supply flow rate Q for the boom/stick cylinders 8, 9, as required supply flow rate of first and second hydraulic pumps A, B is set up for each hydraulic pump, as mentioned above, the target supply flow rates Qa, Qb (Qa+Qb=Q) for first and second hydraulic pumps A, B are set up for each hydraulic pump; the target supply flow rates Qb, Qa of second and first hydraulic pumps B, A connected over the boom's/stick's main side supply oil passages 17, 16 are set up over full operation range of the boom's/stick's manipulators, but the target supply flow rates Qa, Qb of first and second hydraulic pumps A, B connected over the boom's/stick's subside supply oil passages 14, 18 are calculated only when the operating amount of manipulator is not less than the preset value L. Note that the required and target supply flow rate setting parts 62, 63 are equivalent to target supply flow rate setting means of this invention.

An explanation will be provided about the control performed in each part of the boom/swiveling/stick/bucket control parts 64, 65, 66, and 67, but first of all, an explanation is provided about the swiveling/bucket control parts 65, 67 controlling the swiveling motor 11/bucket cylinder 10.

The swiveling control part 65 has a direction change-over valve control block 65*a* for controlling swiveling's direction change-over valve 24. The direction change-over valve control block 65*a* calculates the opening area of the supply valve passage 24*e* to the swiveling's direction change-over valve 24 corresponding to the target supply flow rate Q of swiveling motor 11 calculated in the target supply flow rate setting part 63, further calculates the spool move position of swiveling's direction change-over valve 24 when the opening area is reached, and outputs the control signal to swiveling's left turning/right turning proportional solenoid valves 44*a*, 44*b* so as to move to the spool move position. The supply/discharge flow rates for swiveling motor 11 are to be controlled depending on the opening area of the supply/discharge valve passages 24*e*, 24*f* at the spool move position. The direction change-over valve control block 65*a* installed in the swiveling control part 65 is equivalent to the direction change-over valve control means of this invention.

The direction change-over valve control block 65*a* has the data, such as a map, which represents the relationship between the target supply flow rate Q and opening area of the supply valve passage 24*e* to the swiveling's direction change-over valve 24, the block 65*a* uses the data to calculate the opening area of the supply valve passage 24*e* corresponding to the target supply flow rate Q, and the data is to be incorporated into the direction change-over valve control block 65*a* as a control parameter; the opening area value of the supply valve passage 24*e* to the swiveling's direction change-over valve corresponding to the target supply flow rate Q may be changed according to the content of work performed by hydraulic actuator 1, for example. Also, the direction change-over valve control blocks 64*a*, 66*a*, and 67*a* installed in the boom/stick/bucket control parts 64, 66, and 67 have the data, such as a map, which represents the relationship between the target supply flow rate Q and opening area of the supply valve passages 23*e*, 25*e*, and 26*e* to the boom's/stick's/bucket's direction change-over valves 23, 25, and 26, and the opening area value of the supply valve passages 23*e*, 25*e*, and 26*e* corresponding to the target supply flow rate Q may be changed.

The bucket control part 67 has a direction change-over valve control block 67*a* for controlling bucket's direction change-over valve 26; the direction change-over valve control block 67*a* calculates the opening area of the supply valve passage 26*e* to the bucket's direction change-over valve 26 corresponding to the target supply flow rate Q of bucket cylinder 10 calculated in the target supply flow rate setting part 63, further calculates the spool move position of the bucket's direction change-over valve 26 when the opening area is reached, and outputs the control signal to bucket's extended side/contracted side proportional solenoid valves 46*a*, 46*b* so as to move to the spool move position. The supply/discharge flow rates are to be controlled for the bucket cylinder 10 depending on the opening area of supply/discharge valve passages 26*e*, 26*f* at the spool move position.

Next, an explanation is provided about the stick control part 66 for controlling the stick cylinder 9; the stick control part 66 is installed with: the direction change-over valve control block 66*a* for controlling stick's direction change-over valve 25, first target differential pressure setting block 66*b* for setting up the target differential pressure ΔPt between first hydraulic pump A's delivery pressure and supply pressure to the stick cylinder 9, first flow control valve control block 66*c* for controlling stick's first flow control valve 30, second target differential pressure setting block 66*d* for setting up the target differential pressure ΔPt between second hydraulic pump B's delivery pressure and supply pressure to the stick cylinder 9, and second flow control valve control block 66*e* for controlling stick's second flow control valve 31. The stick cylinder 9 uses both first and second hydraulic pumps A, B as hydraulic supply source, as mentioned above, the first hydraulic pump A, which supplies pressured oil to the swiveling motor 11, is to supply pressured oil over full operation range of the stick's manipulator, and the stick cylinder 9 is equivalent to working machine's hydraulic actuator of this invention sharing the hydraulic pump with swiveling motor. Also, the direction change-over valve control block 66*a*, first target differential pressure setting block 66*b*, and first flow control valve control block 66*c* installed in the stick control part 66 are equivalent respectively to the direction change-over valve control means, target differential pressure setting means, and flow control valve control means of this invention.

When the target supply flow rate Q for the stick cylinder 9 is input by the target supply flow rate setting part 63, the direction change-over valve control block 66*a* in the stick control part 66 calculates the opening area of supply valve passage 25*e* to stick's direction change-over valve 25 corresponding to the target supply flow rate Q, further calculates the spool move position of the stick's direction change-over valve 25 when the opening area is reached, and outputs the control signal to stick's extended side/contracted side proportional solenoid valves 45*a*, 45*b* so as to move to the spool move position. As for the target supply flow rate Q of the stick cylinder 9, as mentioned above, the target supply flow rate Qa of first hydraulic pump A connected over the stick's main side supply oil passage 16 is calculated over full operation range of the stick manipulator, but the target supply flow rate Qb of second hydraulic pump B connected over the stick's subside supply oil passage 18 is calculated only when the operating amount of manipulator is not less than the preset value L.

Figure 5:
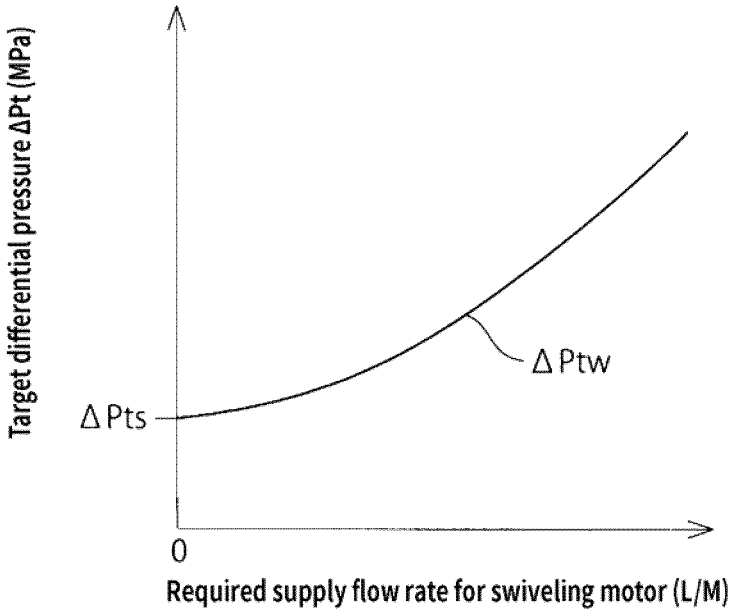
FIG. 5 is a diagram illustrating the relationship between a target differential pressure between a first hydraulic pump's delivery pressure and supply pressure to stick cylinder and required supply flow rate for swiveling motor.

The first target differential pressure setting block 66*b* in the stick control part 66 sets up the target differential pressure ΔPt as the target of differential pressure between the delivery pressure of first hydraulic pump A, which supplies pressured oil to the stick's first flow control valve 30, and supply pressure to the stick cylinder 9. Here, the first target differential pressure setting block 66*b* inputs the required supply flow rate for swiveling motor 11 set up in the required supply flow rate setting part 62; when the required supply flow rate is zero for swiveling motor 11 (swiveling manipulator is not operated), the target differential pressure ΔPt is set to target differential pressure ΔPts during non-swivel interlocking operation; when the required supply flow rate is not zero for swiveling motor 11 (swiveling manipulator is operated), the target differential pressure ΔPt is set to target differential pressure ΔPtw during swivel interlocking operation. The value of the target differential pressure ΔPtw during swivel interlocking operation is set up to increase gradually from the value of target differential pressure ΔPts during non-swivel interlocking operation as a start point as the required supply flow rate for the swiveling motor 11 increases (operating amount of the swiveling manipulator increases, see FIG. 5).

The target differential pressure ΔPts during non-swivel interlocking operation may be a fixed value or the value specified in the map of operating amount of stick manipulator; when the stick manipulator is not operated interlockingly (concurrently) with the swiveling manipulator, the relationship is designed and adjusted in advance between the pump flow rate to the operating amount of stick manipulator and opening area of supply valve passage 25*e* to the stick's direction change-over valve so as to keep the target differential pressure ΔPts during non-swivel interlocking operation.

Figure 4:
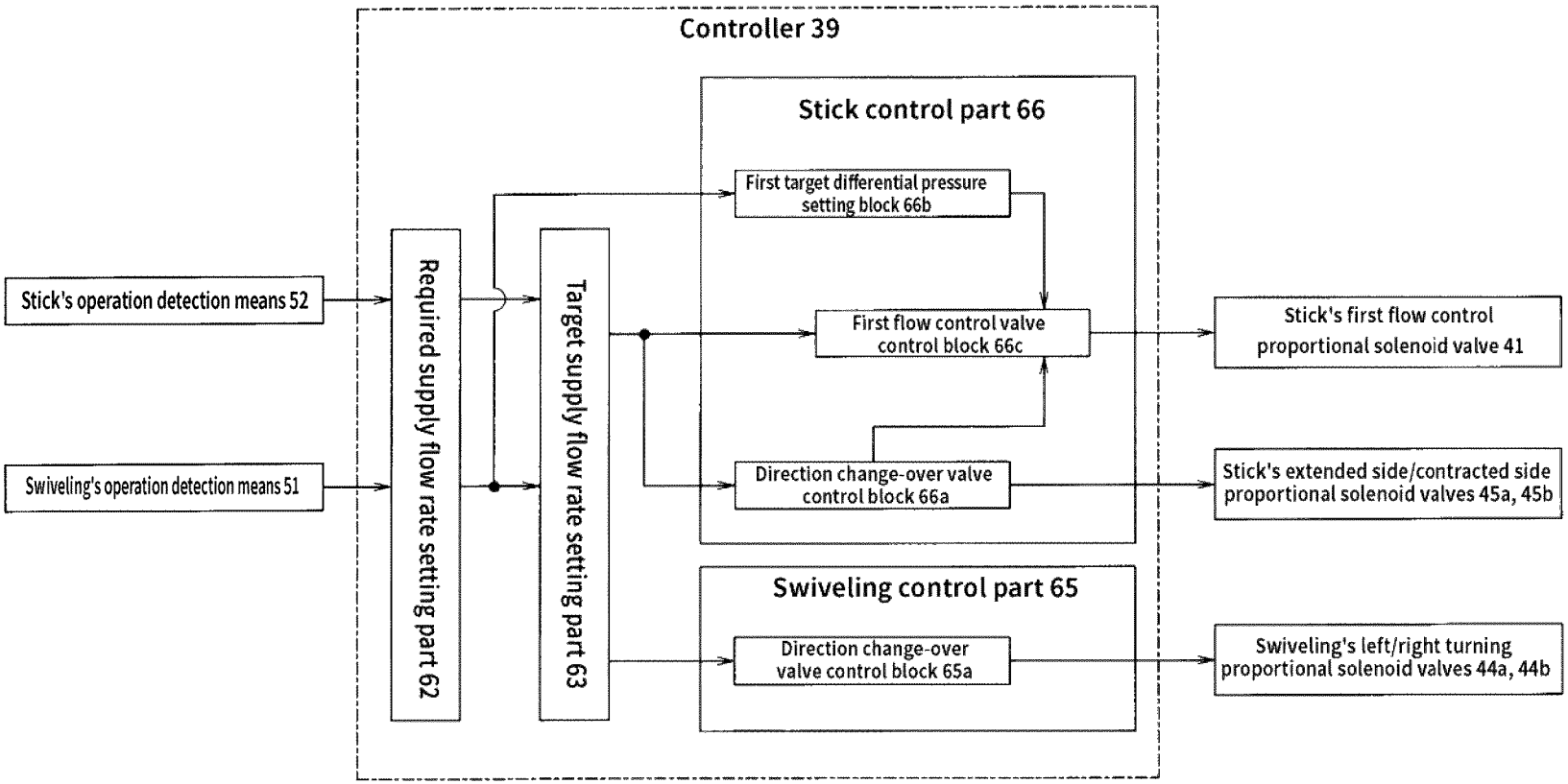
FIG. 4 is a control logic diagram for interlocking operation of swiveling and stick manipulators.

When the target supply flow rate Qa of first hydraulic pump A for stick cylinder 9 is input from the target supply flow rate setting part 63, the first flow control valve control block 66*c* in the stick control part 66, as illustrated in the control logic diagram in the FIG. 4, outputs the control signal to the stick's first flow control proportional solenoid valve 41 so as to open stick's first flow control valve 30 connected to first hydraulic pump A. Here, the first flow control valve control block 66*c* is to input the values of: the target supply flow rates Qa, Qb from first and second hydraulic pumps A, B to stick cylinder 9, the opening area As of supply valve passage 25*e* to the stick's direction change-over valve calculated in the direction change-over valve control block 66*a*, and the target differential pressure ΔPt (target differential pressure ΔPts during non-swivel interlocking operation or target differential pressure ΔPtw during swivel interlocking operation), which is set up in the first target differential pressure setting block 66*b* between first hydraulic pump A and supply pressure to the stick cylinder 9, calculate the target opening area Af of stick's first flow control valve 30 based on these values, and control the opening area of stick's first flow control valve 30 so as to keep the target opening area Af; the explanation is provided about how to calculate the target opening area Af below.

First, the first flow control valve control block 66*c* calculates differential pressure ΔPs before and after the target supply flow rate Q passes through the supply valve passage 25*e* to stick's direction change-over valve based on the target supply flow rate Q from both first and second hydraulic pumps A, B to stick cylinder 9 and the opening area As of the supply valve passage 25*e* to the stick's direction change-over valve, using a formula (1) below. Further, the control block 66*c* calculates the differential pressure ΔPf before and after the stick's first flow control valve 30 based on the differential pressure ΔPs calculated before and after the supply valve passage 25*e* to the stick's direction change-over valve and the target differential pressure ΔPt between the first hydraulic pump A's delivery pressure and supply pressure to stick cylinder 9, using the formula (2) below. The control block 66*c* calculates the target opening area Af of the stick's first flow control valve 30 when the target supply flow rate Qa passes through the stick's first flow control valve 30 from first hydraulic pump A based on the differential pressure ΔPf calculated before and after the stick's first flow control valve 30 and target supply flow rate Qa from first hydraulic pump A, which supplies pressured oil to the valve 30, using the formula (3) below:

$$\Delta Ps = \{Q/(C \cdot As)\}2 \tag{1}$$

$$\Delta Pf = \Delta Pt - \Delta Ps \tag{2}$$

$$Af = Qa/(C \cdot \sqrt{\Delta Pf}) \tag{3}$$

Where, in formulas (1), (2), and (3), ΔPs is differential pressure before and after the supply valve passage 25*e* to the stick's direction change-over valve, Q is the target supply flow rate from both first and second hydraulic pumps A, B to stick cylinder 9, As is the opening area of supply valve passage 25*e* to the stick's direction change-over valve, ΔPf is the differential pressure before and after stick's first flow control valve 30, ΔPt is the target differential pressure between first hydraulic pump A's delivery pressure and supply pressure to stick cylinder 9, Af is the target opening area of stick's first flow control valve 30, Qa is the target supply flow rate from first hydraulic pump A, and C is a factor.

Also, the formulas (1), (3) are derived from an orifice flow formula (4) shown below:

$$Q = C \cdot A \cdot \sqrt{\Delta P} \tag{4}$$

Where in the formula (4), Q is an orifice flow rate, A is an orifice opening area, ΔP is an orifice differential pressure, and C is the factor.

The first flow control valve control block 66*c* controls the stick's first flow control valve 30 so as to keep the target opening area Af calculated, thus the flow rate passing through the stick's first flow control valve 30 is to be controlled to be the target supply flow rate Qa from first hydraulic pump A to stick cylinder 9; here, the target opening area Af will be smaller as the differential pressure ΔPf before and after the stick's first flow control valve 30, as is evident from the formulas (1) to (3), and the differential pressure ΔPf of stick's first flow control valve 30 will be larger as the target differential pressure ΔPt of stick's first flow control valve 30 increases between the first hydraulic pump A's delivery pressure and supply pressure to stick cylinder 9. That is to say, the target opening area Af of the stick's first flow control valve 30 is controlled to be smaller as the target differential pressure ΔPt increases between the first hydraulic pump A's delivery pressure and supply pressure to stick cylinder 9; in the first target differential pressure setting block 66*b*, as mentioned above, the target differential pressure ΔPt is set to the target differential pressure ΔPts during non-swivel interlocking operation when swiveling manipulator is not operated; when the swiveling manipulator is operated, the target differential pressure ΔPt is set up to the target differential pressure ΔPtw during swivel interlocking operation which will increase more as the required supply flow rate for the swiveling motor 11 increases from the target differential pressure ΔPts during non-swivel interlocking operation (operating amount of the swiveling manipulator increases). Thus, during interlocking operation of stick and swiveling manipulators, the opening area of stick's first flow control valve 30 is to be controlled to be smaller as the required supply flow rate for the swiveling motor 11 increases, compared with a single operation of stick manipulator. The supply flow rate from first hydraulic pump A to the stick cylinder 9 is to be restricted by decreasing the opening area of stick's first flow control valve 30 during interlocking operation with swiveling manipulator, thus enabling to avoid swiveling power reduction due to insufficient supply flow rate to the swiveling motor 11.

The second target differential pressure setting block 66*d* in the stick control part 66 sets up the target differential pressure ΔPt as the target of differential pressure between the delivery pressure of second hydraulic pump B, which supplies pressured oil to the stick's second flow control valve 31, and supply pressure to the stick cylinder 9. The target differential pressure ΔPt is provided as a fixed value or the value specified in the map of operating amount of stick manipulator, similar to the target differential pressure ΔPts during non-swivel interlocking operation set up in the first target differential pressure setting block 66*b*.

When the target supply flow rate Qb of second hydraulic pump B for stick cylinder 9 is input from the target supply flow rate setting part 63 (operating amount of manipulator is not less than the setting value L), the second flow control valve control block 66*e* in the stick control part 66 outputs the control signal to the stick's second flow control proportional solenoid valve 42 so as to open the stick's second flow control valve 31 disposed on the stick's subside supply valve passage 18 connected to second hydraulic pump B. Also, when the target supply flow rate Qb of second hydraulic pump B is zero (operating amount of manipulator is less than the setting value L), stick's second flow control valve 31 is controlled to be closed.

Here, an explanation is provided about the opening area of stick's second flow control valve 31 controlled by the second flow control valve control block 66*e*; the second control block 66*e* is to input the values of: the target supply flow rates Qa, Qb from first and second hydraulic pumps A, B to stick cylinder 9, the opening area As of supply valve passage 25*e* to the stick's direction change-over valve calculated in the direction change-over valve control block 66*a*, and the target differential pressure ΔPt set up in the second target differential pressure setting block 66*d* between second hydraulic pump B and supply pressure to the stick cylinder 9, calculate the target opening area Af of stick's second flow control valve 31 based on these values, and control the opening area of stick's second flow control valve 31 so as to keep the target opening area Af; the explanation is provided about how to calculate the target opening area Af below.

Similar to a case of the first flow control valve control block 66*c*, the second flow control valve control block 66*e* calculates differential pressure ΔPs before and after the target supply flow rate Q passes through the supply valve passage 25*e* to the stick's direction change-over valve based on the target supply flow rate Q (Q=Qa+Qb) from both first and second hydraulic pumps A, B to the stick cylinder 9 and the opening area As of the supply valve passage 25*e* to the stick's direction change-over valve, using the formula (1) above. Further, the control block 66*e* calculates the differential pressure ΔPf before and after the stick's second flow control valve 31 based on the differential pressure ΔPs calculated before and after the supply valve passage 25*e* to the stick's direction change-over valve and the target differential pressure ΔPt between the second hydraulic pump B's delivery pressure and supply pressure to stick cylinder 9, using the formula (2) above. Where, in the formula (2), ΔPf is the differential pressure before and after the stick's second flow control valve 31, ΔPt is the target differential pressure between the second hydraulic pump B's delivery pressure and supply pressure to stick cylinder 9, and ΔPs is the differential pressure before and after the supply valve passage 25*e* to the stick's direction change-over valve. Further, the control block 66*e* calculates the target opening area Af of the stick's second flow control valve 31 when the target supply flow rate Qb passes through the stick's second flow control valve 31 from second hydraulic pump B based on the differential pressure ΔPf calculated before and after the stick's second flow control valve 31 and target supply flow rate Qb from second hydraulic pump B, which supplies pressured oil to the stick's second flow control valve 31, using the formula (5) below similar to the formula (3):

$$Af = Qb/(C \cdot \sqrt{\Delta Pf}) \tag{5}$$

Where, in the formula (5), Af is the target opening area of stick's second flow control valve 31, Qb is the target supply flow rate from second hydraulic pump B to stick cylinder 9, ΔPf is the differential pressure before and after the stick's second flow control valve 31, and C is the factor.

By controlling the opening area of the stick's second flow control valve 31 so as to keep the target opening area Af thus calculated, the flow rate passing through the stick's second flow control valve 31 is controlled to keep the target supply flow rate Qb from the second hydraulic pump B to the stick cylinder 9.

When the stick manipulator is operated by controls provided by the direction change-over valve control block 66*a*, first target differential pressure setting block 66*b*, first flow control valve control block 66*c*, second target differential pressure setting block 66*d*, and second flow control valve control block 66*e* in the stick control part 66, if the operating amount of manipulator is less than the setting value L, the flow rate to stick cylinder 9 is supplied only from first hydraulic pump A, and the supply flow rate to the stick cylinder 9 is controlled by the opening area of the supply valve passage 25*e* to the stick's direction change-over valve 25 and opening area of the stick's first flow control valve 30. When the operating amount of manipulator is not less than the setting value L, the total flow rate is supplied from both first and second hydraulic pumps A, B to stick cylinder 9 and the supply flow rate to the stick cylinder 9 is controlled by the opening area of supply valve passage 25*e* to the stick's direction change-over valve 25 and opening area of stick's first and second flow control valves 30, 31. The discharge/recycle flow rates for stick cylinder 9 are controlled respectively by the opening area of the discharge/recycle valve passages 25*f*, 25*g* at the spool move position corresponding to the opening area of the supply valve passage 25*e* to stick's direction change-over valve 25. Thus, even if the relationship is unique among opening areas of supply/discharge/recycle valve passages 25*e*, 25*f*, and 25*g* for stick's direction change-over valve 25, when the supply flow rate is increased or decreased to stick cylinder 9 from first and second hydraulic pumps A, B by increasing or decreasing the opening area of stick's first and second flow control valves 30, 31, the relationship can be changed among the supply, discharge, and recycle flow rates for the stick cylinder 9.

Furthermore, when the swiveling motor 11 and stick cylinder 9 sharing first hydraulic pump A are interlocked with each other, as described above, the opening area of stick's first flow control valve 30 is controlled to be smaller as the required supply flow rate for the swiveling motor 11 increases by making the target differential pressure ΔPt between first hydraulic pump A and supply pressure to the stick cylinder 9 larger as the required supply flow rate increases for the swiveling motor 11, and thus the supply flow rate from first hydraulic pump A to the stick cylinder 9 is controlled to be smaller as the required supply flow rate increases for the swiveling motor 11 (operating amount of the swiveling manipulator increases). As the supply flow rate to stick cylinder 9 is restricted by making the stick's first flow control valve 30 function as the swivel preferred flow control valve during interlocking operation with swiveling manipulator, even if the swiveling of upper swiveling body 2 is heavy loaded, it is avoided that many supply flow rates run from first hydraulic pump A into the stick cylinder 9 side to result in a shortage of supply flow rate to swiveling motor 11, holding the swiveling power surely; since the supply flow rate to the stick cylinder 9 is restricted according to the operating amount of swiveling manipulator, the supply flow rate to the stick cylinder 9 is not restricted unnecessarily and appropriate working speed of stick cylinder 9 can be ensured.

Next, an explanation is provided about boom control part 64 controlling the boom cylinder 8; the boom control part 64 is provided with: the direction change-over valve control blocks 64*a* for controlling boom's direction change-over valve 23, target differential pressure setting block 64*b* for setting up the target differential pressure between the first hydraulic pump A's delivery pressure and supply pressure to boom cylinder 8, and flow control valve control block 64*c* for controlling boom's flow control valve 29. The boom cylinder 8 uses both first and second hydraulic pumps A, B as hydraulic supply source, as mentioned above, the first hydraulic pump A, which supplies pressured oil to the swiveling motor 11, is to supply pressured oil only when the operating amount of boom manipulator is not less than the setting value L, and in the present embodiment, the boom cylinder 8 is not equivalent to working machine's hydraulic actuator of this invention sharing hydraulic pump with swiveling motor.

When the target supply flow rate Q for the boom cylinder 8 is input by the target supply flow rate setting part 63, the direction change-over valve control block 64*a* in the boom control part 64 calculates the opening area of the supply valve passage 23*e* to the boom's direction change-over valve 23 corresponding to the target supply flow rate Q, further calculates the spool move position of the boom's direction change-over valve 23 when the opening area is reached, and outputs the control signal to boom's extended side/contracted side proportional solenoid valves 43*a*, 43*b* so as to move to the spool move position. As for the target supply flow rate Q of the boom cylinder 8, as mentioned above, the target supply flow rate Qb of second hydraulic pump B connected over the boom's main side supply oil passage 17 is calculated over full operation range of the boom manipulator, but the target supply flow rate Qa of first hydraulic pump A connected over the boom's subside supply oil passage 14 is calculated only when the operating amount of manipulator is not less than the preset value L.

The target differential pressure setting block 64*b* in the boom control part 64 sets up the target differential pressure ΔPt as the target of differential pressure between the delivery pressure of first hydraulic pump A, which supplies pressured oil to the boom's flow control valve 29, and supply pressure to the boom cylinder 8. The target differential pressure ΔPt may be a fixed value or the value specified in the map of operating amount of manipulator; the relationship is designed and adjusted in advance between the pump flow rate to the operating amount of manipulator and opening area of supply valve passage 23*e* to the boom's direction change-over valve so as to keep the target differential pressure ΔPt.

When the target supply flow rate Qa of first hydraulic pump A for boom cylinder 8 is input from the target supply flow rate setting part 63 (operating amount of manipulator is not less than the setting value L), the flow control valve control block 64*c* in the boom control part 64 outputs the control signal to the boom's flow control proportional solenoid valve 40 so as to open the boom's flow control valve 29 disposed on the boom's subside supply valve passage 14 connected to first hydraulic pump A. Also, when the target supply flow rate Qa of first hydraulic pump A is zero (operating amount of manipulator is less than the setting value L), the boom's flow control valve 29 is controlled to be closed.

Now, an explanation is provided about an opening area control of the boom's flow control valve 29 performed by the flow control valve control block 64*c*. The flow control valve control block 64*c* is to input the values of: the target supply flow rates Qa, Qb from first and second hydraulic pumps A, B to boom cylinder 8, the opening area As of supply valve passage 23*e* to the boom's direction change-over valve calculated in the direction change-over valve control block 64*a*, and the target differential pressure ΔPt set up in the target differential pressure setting block 64*b* between first hydraulic pump A and supply pressure to the boom cylinder 8, calculate the target opening area Af of boom's flow control valve 29 based on these values, and control the opening area of boom's flow control valve 29 so as to keep the target opening area Af; an explanation is provided about how to calculate the target opening area Af below.

First, the flow control valve control block 64*c* calculates differential pressure ΔPs before and after the target supply flow rate Q passes through the supply valve passage 23*e* to the boom's direction change-over valve based on the target supply flow rate Q (Q=Qa+Qb) from both first and second hydraulic pumps A, B to the boom cylinder 8 and the opening area As of the supply valve passage 23*e* to the boom's direction change-over valve, using the formula (1) above. Where, in the formula (1) above, ΔPs is the differential pressure before and after the supply valve passage 23*e* to the boom's direction change-over valve, Q is the target supply flow rate Q from both first and second hydraulic pumps A, B to boom cylinder 8, As is the opening area of supply valve passage 23*e* to boom's direction change-over valve, and C is the factor. Further, the control block 64*c* calculates the differential pressure ΔPf before and after the boom's flow control valve 29 based on the differential pressure ΔPs calculated before and after the supply valve passage 23*e* to the boom's direction change-over valve and the target differential pressure ΔPt between the first hydraulic pump A's delivery pressure and supply pressure to boom cylinder 8, using the formula (2) above. Where, in the formula (2), ΔPf is the differential pressure before and after the boom's flow control valve 29, ΔPt is the target differential pressure between the first hydraulic pump A's delivery pressure and supply pressure to boom cylinder 8, and ΔPs is the differential pressure before and after the supply valve passage 23*e* to the boom's direction change-over valve. The control block 64*c* calculates the target opening area Af of boom's flow control valve 29 when the target supply flow rate Qa passes through the boom's flow control valve 29 from first hydraulic pump A based on the differential pressure ΔPf calculated before and after the boom's flow control valve 29 and target supply flow rate Qa from first hydraulic pump A, which supplies pressured oil to the boom's flow control valve 29, using the formula (3) below:

Where, in the formula (3), Af is the target opening area of boom's flow control valve 29, Qa is the target supply flow rate from first hydraulic pump A to boom cylinder 8, ΔPf is the differential pressure before and after the boom's flow control valve 29, and C is the factor.

By controlling the opening area of the boom's flow control valve 29 so as to keep the target opening area Af thus calculated, the flow rate passing through boom's flow control valve 29 is controlled to keep the target supply flow rate Qa from first hydraulic pump A to boom cylinder 8.

When the boom manipulator is operated by controls provided by the direction change-over valve control block 64*a*, target differential pressure setting block 64*b*, and flow control valve control block 64*c* in the boom control part 64, if the operating amount of boom manipulator is less than the setting value L, the flow rate to boom cylinder 8 is supplied only from second hydraulic pump B, and the supply flow rate to the boom cylinder 8 is controlled by the opening area of supply valve passage 23*e* to boom's direction change-over valve 23. The discharge/recycle flow rates are controlled respectively by opening area of the discharge/recycle valve passages 23*f*, 23*g* at the spool move position corresponding to the opening area of the supply valve passages 23*e* to the boom's direction change-over valve 23.

When the operating amount of manipulator is not less than the setting value L, the total flow rate is supplied from both first and second hydraulic pumps A, B to boom cylinder 8 and the supply flow rate to the boom cylinder 8 is controlled by the opening area of supply valve passage 23*e* to boom's direction change-over valve 23 and opening area of boom's flow control valve 29. Here, the discharge/recycle flow rates are controlled by the opening area of the discharge/recycle valve passages 23*f*, 23*g* at the spool move position corresponding to the opening area of the supply valve passage 23*e* to boom's direction change-over valve 23. Thus, even if the relationship is unique among opening areas of supply/discharge/recycle valve passages 23*e*, 23*f*, and 23*g* for boom's direction change-over valve 23, the relationship can be changed among the supply, discharge, and recycle flow rates for boom cylinder 8 as the supply flow rate to boom cylinder 8 is increased or decreased by increasing or decreasing the opening area of boom's flow control valve 29.

As for the control of the boom cylinder 8, the relationship among the supply, discharge, and recycle flow rates may be changed in an area (operating amount of manipulator is not less than the setting value L) where more hydraulic oil is supplied from both first and second hydraulic pumps A, B, thus the operability and working efficiency can be improved; and in the area (operating amount of manipulator is less than the setting value L) where less hydraulic oil is supplied only from the other hydraulic pump (second hydraulic pump B), controlling the supply flow rate only with the boom's direction change-over valve 23 can omit the flow control valve, which controls boom's main side supply oil passage 17 connected to the other hydraulic pump, and proportional solenoid valve, which pilot-operates the flow control valve, contributing to reduce the number of parts and simplify the circuit.

In this embodiment configured above, the hydraulic control system of hydraulic excavator 1 is installed with: a swiveling motor 11 for swiveling an upper swiveling body 2, a first hydraulic pump A as a hydraulic supply source to the swiveling motor 11, a stick cylinder 9 sharing the first hydraulic pump A with swiveling motor 11, a swiveling's direction change-over valve 24 for having supply/discharge valve passages 24*e*, 24*f* for swiveling motor 11 as well as changing over its supply/discharge directions, a stick's direction change-over valve 25 having supply/discharge valve passages 25*e*, 25*f* for the stick cylinder 9 and changing over its supply/discharge directions, a stick's first flow control valve 30 being arranged at upstream side of the stick's direction change-over valve 25 and controlling supply flow rate from first hydraulic pump A to the stick's direction change-over valve 25, and a controller 39 for controlling an operation of the swiveling's/stick's direction change-over valves 24, 25 and the stick's first flow control valve 30; here, the controller 39 is installed with: required/target supply flow rate setting parts 62, 63 for setting up target supply flow rate from first hydraulic pump A to swiveling motor 11 and stick cylinder 9 depending on the operating amount of swiveling/stick manipulator, direction change-over valve control blocks 65*a*, 66*a* for controlling the opening area of supply/discharge valve passages 24*e*, 25*e*, 24*f*, and 25*f* to the swiveling's/stick's direction change-over valves 24, 25 according to target supply flow rate, first target differential pressure setting block 66*b* for setting up a target differential pressure ΔPt between first hydraulic pump A's delivery pressure and supply pressure to the stick cylinder 9, and a first flow control valve control block 66*c* for controlling opening area Af of stick's first flow control valve 30 based on the target supply flow rate Qa, target differential pressure ΔPt, and opening area As of the supply valve passage 25*e* to the stick's direction change-over valve 25 so as to supply the target supply flow rate Qa from first hydraulic pump A to the stick cylinder 9; the first target differential pressure setting block 66*b*, during interlocking operation of the swiveling motor 11 and stick cylinder 9, sets the target differential pressure ΔPt between the first hydraulic pump A's delivery pressure and supply pressure to stick cylinder 9 (target differential pressure ΔPtw during swivel interlocking operation) larger than the target differential pressure ΔPt (target differential pressure ΔPts during non-swivel interlocking operation) during non-swivel interlocking operation of the swiveling motor 11 and stick cylinder 9 as the operating amount of swiveling manipulator increases; the first flow control valve control block 66*c* controls to set the opening area of stick's first flow control valve 30 smaller as the target differential pressure ΔPt increases.

Thus, during interlocking operation of the swiveling motor 11 and stick cylinder 9 sharing first hydraulic pump A with each other, the opening area of the stick's first flow control valve 30 is controlled to be smaller as the operating amount of swiveling manipulator increases, so that the supply flow rate to stick cylinder 9 is restricted to be reduced more as the operating amount of swiveling manipulator increases. Even if the swiveling of upper swiveling body 2 is heavy loaded, it is avoided that many supply flow rates run from first hydraulic pump A into the stick cylinder 9 side to result in the shortage of supply flow rate to swiveling motor 11, holding the swiveling power surely; since the flow rate to the stick cylinder 9 is restricted according to the operating amount of swiveling manipulator, the flow rate to the stick cylinder 9 is not restricted unnecessarily and appropriate working speed of stick cylinder 9 can be ensured.

In the present embodiment, the swiveling power can be ensured by making the stick's first flow control valve 30 function as the swivel preferred flow control valve and restricting the supply flow rate from first hydraulic pump A to stick cylinder 9 during interlocking operation of the swiveling motor 11 and stick cylinder 9; the stick's first flow control valve 30 controls the opening area so as to supply the target supply flow rate Qa from first hydraulic pump A to stick cylinder 9, its opening area control is performed based on the target supply flow rate Qa, target differential pressure ΔPt between the first hydraulic pump A's delivery pressure and supply pressure to stick cylinder 9, and opening area As of supply valve passage 25*e* to the stick's direction change-over valve 25, so that the supply flow rate can be accurately controlled corresponding to the target supply flow rate Qa, target differential pressure ΔPt, and opening area As of the supply valve passage 25*e*; during interlocking operation of the swiveling motor 11 and stick cylinder 9, the target differential pressure ΔPt (target differential pressure ΔPtw during swivel interlocking operation) is set larger than the target differential pressure ΔPt (target differential pressure ΔPts during non-swivel interlocking operation) during non-swivel interlocking operation as the operating amount of swiveling manipulator increases, controlling to make the opening area of the stick's first flow control valve 30 smaller. Thus, the opening area of stick's first flow control valve 30, which functions as the swivel preferred flow control valve, can be controlled easily only by changing target differential pressure ΔPf setting during swivel interlocking operation based on the opening area controlled by stick's first flow control valve 30 during non-swivel interlocking operation, helping to simplify the control and reducing time to tune only during swivel interlocking operation.

Further, when controlling the opening area of the stick's first flow control valve 30, it is configured to control stick's first flow control valve 30 so as to keep its target opening area Af by calculating the differential pressure ΔPs before and after the supply valve passage 25*e* based on the target supply flow rate Q to the stick cylinder 9 and the opening area As of supply valve passage 25*e* to the stick's direction change-over valve 25 and by calculating differential pressure ΔPf before and after the stick's first flow control valve 30 based on a target differential pressure ΔPt and the differential pressure ΔPs calculated before and after the supply valve passage 25*e*, further calculating the target opening area Af of the stick's first flow control valve 30 based on the differential pressure ΔPf calculated before and after the stick's first flow control valve 30 and the target supply flow rate Qa from first hydraulic pump A to stick cylinder 9; this enables to accurately control the target opening area Af of the stick's first flow control valve 30 for supplying the target supply flow rate Qa from first hydraulic pump A to the stick cylinder 9, helping to improve the accuracy of the supply flow rate control.

Note that this invention is obviously not limited to the embodiment mentioned above; for example, the opening area of supply valve passage to working machine's direction change-over valve may be designed to be so large that differential pressure does not occur before and after the supply valve passage. In this case, the supply flow rate from hydraulic pump controlled by the flow control valve will be supplied without the least pressure loss through the working machine's supply valve passage to working machine's hydraulic actuator; in this configuration, this invention may be implemented by controlling the opening area of the flow control valve based on the target supply flow rate from hydraulic pump to working machine's hydraulic actuator and target differential pressure between the hydraulic pump's delivery pressure and supply pressure to the working hydraulic actuator and by setting the target differential pressure larger during interlocking operation of the swiveling motor and working machine's hydraulic actuator as the operating amount of swiveling manipulator increases.

In the embodiment above, although the flow control valve is not installed in the boom's main side supply oil passage 17, the flow control valve may be disposed in the boom's main side supply oil passage 17 for controlling the supply flow rate from second hydraulic pump B to boom's direction change-over valve 23, similar to boom's subside supply oil passage 14. Here, the relationship between the supply and discharge flow rates of the boom cylinder 8 can be changed in a whole operation range by setting the flow control valve arranged at the boom's main side supply oil passage 17 to open in the whole operation range of manipulator and controlling its opening area in the same way as the opening area control of boom's flow control valve 29.

Moreover, the swiveling's/bucket's supply oil passages 15, 19 may be configured to have the flow control valve, and here, the number of parts may increase, but the relationship between the supply and discharge flow rates of the swiveling motor 11 and bucket cylinder 10 can also be changed.

As the working machine's hydraulic actuator sharing hydraulic pump with swiveling motor, this invention may be obviously implemented into the other working machine's hydraulic actuators disposed on excavator type construction machine without being limited to the stick cylinder.

INDUSTRIAL APPLICABILITY

This invention is available for use in the hydraulic control system of excavator type construction machine such as hydraulic excavator installed with swiveling motor.

The invention claimed is:

1. A hydraulic control system for an excavator type construction machine with an upper swiveling body swivelably supported on a lower traveling body and a working machine mounted on the upper swiveling body, the hydraulic control system comprising:

a swiveling motor for swiveling the upper swiveling body;

a hydraulic pump as a hydraulic supply source to the swiveling motor;

a hydraulic actuator for actuating the working machine, sharing the hydraulic supply source with the swiveling motor;

a first direction change-over valve having a first supply valve passage and a first discharge passage connected to the swiveling motor and configured to selectively change supply/discharge directions;

a second direction change-over valve having a second supply valve passage and a second discharge passage connected to the hydraulic actuator and configured to selectively change supply/discharge directions;

a flow control valve arranged at an upstream side of the second direction change-over valve for controlling a supply flow rate from the hydraulic pump to the second direction change-over valve; and a controller for controlling an operation of the first direction change-over valve, the second direction change-over valve, and the flow control valve, the controller:

calculates a target supply flow rate from the hydraulic pump to the swiveling motor and the hydraulic actuator, controls an opening area of each of the first supply valve passage and the first discharge valve passage of the first direction change-over valve and the second supply valve passage and the second discharge passage of the second direction change-over valve, calculates a target differential pressure between a delivery pressure of the hydraulic pump and a supply pressure to the hydraulic actuator, and controls an opening area of the flow control valve based on the target supply flow rate, the target differential pressure, and the opening area of the second supply valve passage of the second direction change-over valve;

wherein, when the swiveling motor and the hydraulic actuator are operated concurrently with each other, the target differential pressure is larger than the target differential pressure when the swiveling motor and the hydraulic actuator are not operated concurrently, and as an operating amount of the swiveling motor increases, the controller increases the target differential pressure and decreases the opening area of the flow control valve.

2. The hydraulic control system for an excavator type construction machine as claimed in claim 1, wherein, when controlling the opening area of the flow control valve, the controller:

calculates a target opening area after calculating a differential pressure before and after the second supply valve passage of the second direction change-over valve based on the target supply flow rate and the opening area of the second supply valve passage;

calculates a differential pressure before and after the flow control valve based on a differential pressure calculated before and after the second supply valve passage and the target differential pressure; and adjusts the calculation of the target opening area of the flow control valve based on the differential pressure calculated before and after the flow control valve and the target supply flow rate.

* * * * *